United States Patent [19]

Suzuki

[11] Patent Number: 4,738,056

[45] Date of Patent: Apr. 19, 1988

[54] METHOD AND BLASTING APPARATUS FOR PREPARATION OF SILICON WAFER

[75] Inventor: Akira Suzuki, Gottemba, Japan

[73] Assignee: Fuji Seiki Machine Works, Ltd., Shizuoka, Japan

[21] Appl. No.: 27,294

[22] Filed: Mar. 17, 1987

Related U.S. Application Data

[62] Division of Ser. No. 811,611, Dec. 20, 1985, Pat. No. 4,679,395.

[30] Foreign Application Priority Data

Dec. 28, 1984 [JP] Japan ..... 59-274949

[51] Int. Cl.[4] ..... B24C 3/12

[52] U.S. Cl. ..... 51/413; 51/421; 51/417; 51/356; 51/277; 51/235; 51/237 T

[58] Field of Search ..... 51/421, 419, 413, 417–418, 51/410, 356, 277, 237 T, 237 M, 240 T, 235

[56] References Cited

U.S. PATENT DOCUMENTS

| | | | |
|---|---|---|---|
| 1,384,278 | 7/1921 | Slocombe | 51/235 |
| 1,966,571 | 7/1934 | Webb | 51/421 |
| 2,306,842 | 12/1942 | Minich | 51/419 |
| 2,345,648 | 4/1944 | Wolfskill . | |
| 3,270,464 | 9/1966 | Bowling, Jr. et al. . | |
| 3,492,763 | 2/1970 | Walsh . | |
| 3,694,972 | 10/1972 | Emeis | 51/410 |
| 3,701,696 | 10/1972 | Mets . | |
| 4,042,419 | 8/1977 | Heinke et al. . | |

FOREIGN PATENT DOCUMENTS

| | | | |
|---|---|---|---|
| 61-91936 | 5/1986 | Japan . | |
| 0592585 | 2/1978 | U.S.S.R. | 51/421 |

OTHER PUBLICATIONS

Gettering Process; Buechele et al.; IBM Technical Disclosure Bulletin; vol. 21, No. 8, Jan. 1979.

*Primary Examiner*—Frederick R. Schmidt
*Assistant Examiner*—Robert A. Rose
*Attorney, Agent, or Firm*—Flynn, Thiel, Boutell & Tanis

[57] ABSTRACT

A process and apparatus for improving the finishing of silicon wafers intended for use as a base plate of an I.C. device. After the wafer has been cut from a silicon crystal and initially ground, then a slurry of water and silicon carbide particles is blasted against the surface to create a mattelike satin finish. This surface is then lapped to provide a mirrorlike finish.

To perform the method, the wafer is disposed in a cup-like fixture constructed of resilient material, which fixture defines a cylindrical recess which is of a diameter slightly greater than that of the wafer. The fixture has a support projecting upwardly from the bottom wall and defining an annular drainage passage therearound, which support has the wafer positioned thereon. The blasting media is ejected into the fixture to finish the surface on the wafer, and the slurry drains downwardly around the edge of the wafer into the annular drain passage, and then out through outlet openings which project radially through the wall of the fixture.

8 Claims, 2 Drawing Sheets

METHOD AND BLASTING APPARATUS FOR PREPARATION OF SILICON WAFER

This is a division of application Ser. No. 811,611, filed Dec. 20, 1985, now U.S. Pat. No. 4,679,395.

FIELD OF THE INVENTION

This invention relates to a finishing method for a silicon wafer used as a base board in an I.C. device and, more particularly, related to an improved method employing a blasting step, and the apparatus for carrying out such step.

BACKGROUND OF THE INVENTION

Hitherto, the silicon wafer which is used as the base board of an I.C. device has been made from a monocrystal silicon block by the following processes. The silicon block is sliced by diamond cutting wheel to form a thin disc, the disc is then ground to form parallel surfaces, and is thereafter lapped on the surfaces thereof by isolated abrasive particles so that the disc has a thickness of 0.1 to 0.6 mm with mirror-like flat surfaces. The lapping step removes small cracks and the metamorphosed layer which is formed on the surface during the diamond wheel cutting and subsequent grinding steps. Such finishing process is necessary for the base plate to have a properly finished surface.

The finishing process requires a long processing time because the lapping operation can not be performed with too much pressure as it is necessary to avoid impregnation of abrasive particles in the surface of the chip. On the other hand, the metamorphosed layer must be removed. Thus, a long operation time is necessary for the lapping to remove the metamorphosed layer if lapping is done with low pressure. For example, it takes 35 to 40 minutes to reduce the thickness of the silicon wafer by about 25 $\mu$m.

Accordingly, this invention provides a method and its apparatus which solves such inefficient silicon wafer lapping process.

According to the present invention, the wafer is subjected to a blasting step between the grinding and lapping steps, during which a slurry of silicon carbide and water is blasted against the surfaces of the wafer to reduce the roughness thereof prior to the lapping step.

The blasting apparatus of the invention, for carrying out the process, includes a blasting device for blasting slurry composed of silicon carbide and water, a silicon wafer fixture made of resilient material, the fixture being of a hollow cylindrical shape to support and confine the wafer, the hollow section having an inner diameter a bit larger than the diameter of the wafer and having a supporting mount in the middle of the hollow section for engaging the underside of the wafer, a drain passage being provided between the cylinder wall and the mount, the drain having an outlet through the cylinder wall, a board loading the fixture thereon, and a transfer device for feeding the board into a blasting chamber.

DETAILED DESCRIPTION

Figure 1:
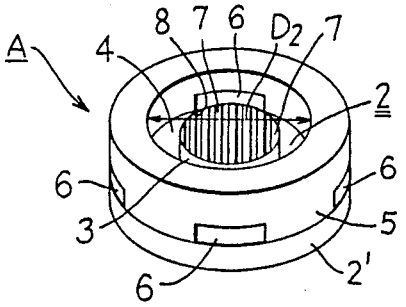
Fig. 1 is a perspective view of the silicon wafer fixture.
Figure 2:
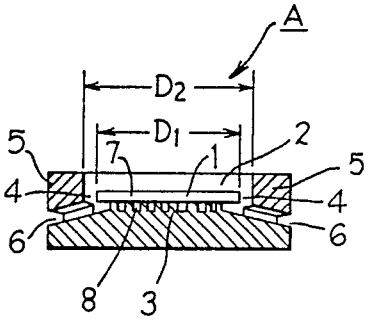
FIG. 2 is a central sectional view of the silicon wafer fixture.

Considering first the fixture used for supporting the silicon wafer during blasting thereof, such fixture is illustrated in FIGS. 1 and 2. The fixture A has an upwardly opening cup-shaped configuration and includes a hollow cylindrical or tubelike section 2 which projects upwardly from a base 2'. The fixture A is adapted to support within the interior thereof a wafer 1, which wafer has a diameter $D_1$ which is slightly smaller than the inner diameter $D_2$ of the cylindrical section 2. The base 2' defines thereon an upwardly projecting cylindrical support or mount 3 which projects upwardly into the interior of the cylindrical section 2 through a small extent, with the upper surface 7 of this mount being spaced downwardly a substantial distance from the upper end of the fixture so as to permit the wafer 1 to be supported thereon. The upper surface 7 of the mount has a plurality of grooves 8 formed therein, which grooves extend in parallel and transversely across the surface of the mount. The mount 3 maintains the wafer 1 spaced upwardly from the bottom of the recess defined within the fixture, and since the wafer 1 is supported on the mount and has a diameter less than the diameter $D_2$, there is hence defined an annular recess or passage 4 which surrounds the mount 3 and the wafer 1 so as to function as a drain. This passage 4 communicates with a plurality of outlet passages 6 which project radially outwardly through the exterior side wall 5 of the fixture, these outlets 6 being sloped downwardly as they project radially outwardly to facilitate draining of the slurry from the fixture. A plurality of outlets 6 are preferably provided in uniformly angularly spaced relationship around the fixture, the fixture being provided with four such outlets in the illustrated embodiment.

Figure 3:
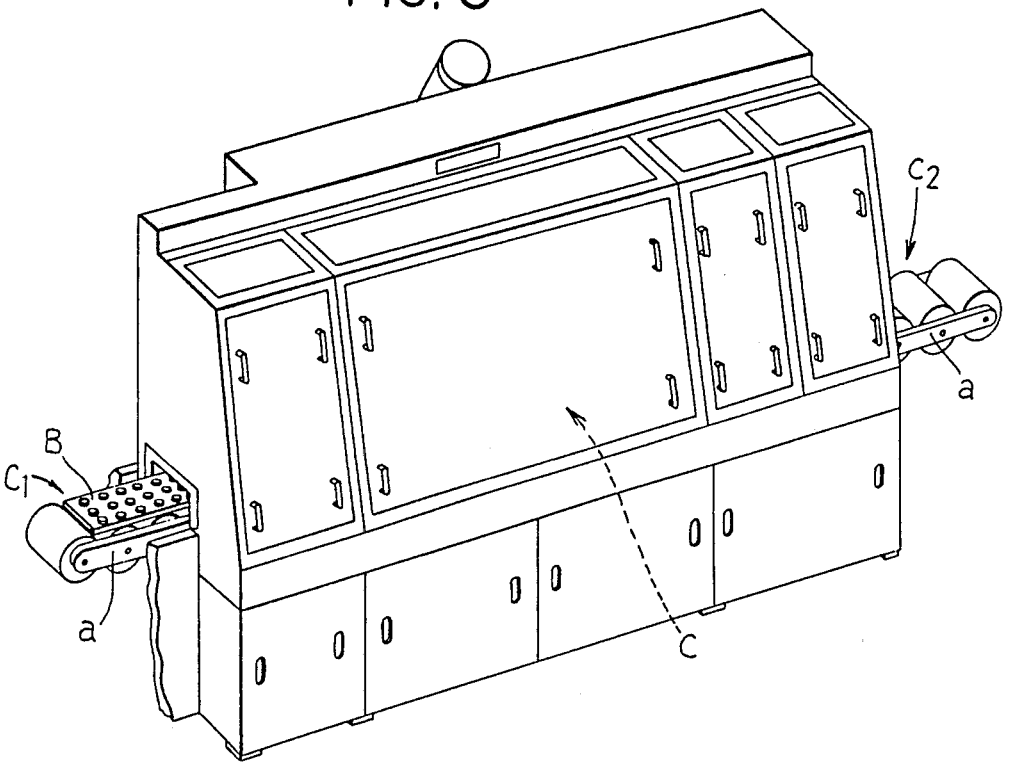
FIG. 3 is a perspective view of a blasting machine.
Figure 4:
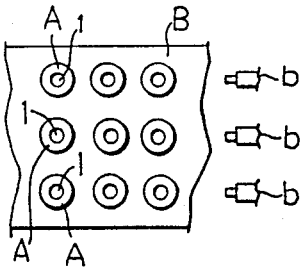
FIG. 4 is an arrangement of the wafer fixtures on a support board.

To perform the blasting operation, a plurality of the fixtures A, each containing a wafer 1 therein, are supported on a substantially flat platelike support or board B as illustrated in FIG. 4, which board can then be transferred into the blasting section C (FIG. 3) of a wet blasting machine. When positioned within the blasting section C, a slurry of silicon carbide particles and water is blasted from nozzles or guns b against the upper surfaces of the wafers as supported within the fixtures A so as to effect a smoothing and hence a finishing of the upper surfaces of the wafers.

The blasting machine as illustrated by FIG. 3 defines therein an interior or enclosed blasting section C, and a roller conveyor a is provided for feeding the fixtures into and out of the blasting machine. After the silicon wafers have been sliced and ground, then a wafer is positioned within each fixture A, with a plurality of fixtures preferably being mounted on each board B, such as three rows of fixtures each containing a plurality of fixtures, there being three within each row as illustrated in FIG. 4. The board is positioned on the inlet end $C_1$ of the conveyor a, and is thereafter fed into the blasting section. In the illustrated embodiment, the blasting machine has a line of three nozzles b positioned within the blasting section and extending transversely relative to the conveyor so that each blasting nozzle will hence be effective for one row of fixtures. The board supporting the fixtures thereon, after being loaded on the conveyor at the inlet end $C_1$ and fed into the blasting section, is thereafter fed through the blasting section and out of the blasting machine at the discharge end $C_2$ of the conveyor, at which point the board can be appropriately unloaded.

The fixture A is made of resilient or rubberlike material such as natural rubber of Durometer hardness of about 60 or below, or various synthetic rubbers such as polyisoprene, polybutadiene, neoprene, chloroprene or polyurethane.

The provision of the grooves 8 in the upper surface 7 of the mount 3 ensure that the slurry will all properly drain from the fixture, and will prevent the slurry from becoming trapped under the wafer.

Inasmuch as the silicon wafer 1 is of a thin, light and brittle material, it is very fragile and can be easily broken by light impact. Care must be exercised that the wafer not be broken by the pressure of the blasting stream, or that the wafer not be blown off or out of the fixture. Further, the wafer will readily break if subjected to a blasting pressure on the upper side thereof while being held from the edge thereof. Hence, in the fixture of this invention, the wafer is kept in a loosely fitting state within the hollow space, the diameter $D_2$ of which is just a bit larger than the diameter $D_1$ of the wafer.

The surface 7 of the mount 3 can be selected in accordance with the type of blasting pressure being utilized. In the case when pressure of the blasting stream is weak or small, the surface 7 may be rather hard without damaging or breaking the wafer. However, in the case where the blasting stream pressure is high or strong, then the surface 7 is preferably coated with a sheet of fiber or other porous material so as to create a resilient cushioning effect for the wafer.

Silicon carbide is preferred as the blasting particles inasmuch as it defines sharp, needlelike crystals that have excellent cutting capacity, although such particles lack ductility and easily break down. However, the keen or sharp edge of the silicon particles is highly effective for shearing and cutting off the metamorphosed layer which is formed on the surface of the silicon wafer at the time of cutting by the diamond wheel. Also, the silicon carbide particles leave the wafer with a surface resembling a satin matte finish, which is highly desirable for final finishing of the wafer by lapping. On the other hand, if another kind of abrasive were utilized, such as aluminum oxide, then the aluminum ions would remain as inclusions in the surface of the wafer, and this would cause undesirable effects with respect to the subsequent forming of electronic circuits on the wafer.

Figure 6:
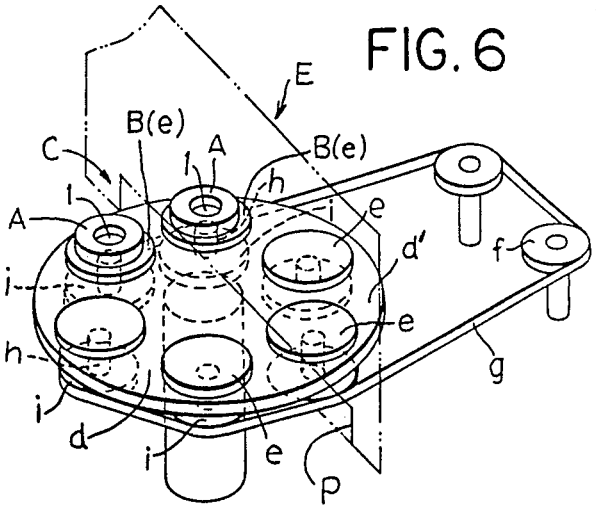
FIG. 6 is a general view of the index table and circular plates in the machine in FIG. 5.
Figure 5:
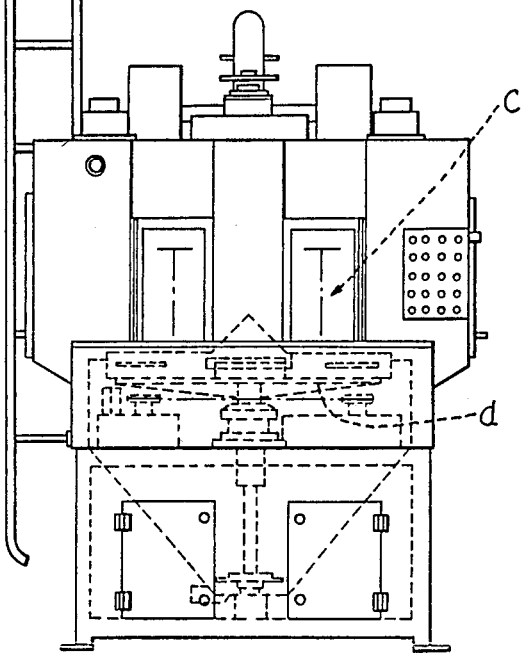
FIG. 5 illustrates another blasting machine.

Referring now to FIGS. 5 and 6, there is illustrated another example of a blasting machine which is highly desirable for use in finishing wafers employing the fixture A of this invention.

When using a machine of the type illustrated by FIGS. 5 and 6, the fixtures A are not mounted on the large board B, but rather an individual fixture A is mounted on a small circular support board or plate e, the individual plates e being mounted on an index table d associated with the blasting machine. The index table d is disposed within the blasting section C of the blasting machine, although a portion of the table projects outwardly from the blasting section through an access opening p as formed in a side wall of the machine so as to permit workpieces, specifically fixtures A, to be mounted on or removed from the support plates e.

The index table supports thereon a plurality of the circular plates e disposed adjacent the periphery thereof in angularly spaced relationship around the table. Each of these plates e is individually rotatably supported on the index table for rotation about its own spindle h, which spindle at its lower end mounts thereon a pulley i which is adapted for engagement with a driving belt g. This driving belt g engages the pulleys i associated with several of the plates e, and the driving belt g projects outwardly from the blasting section and extends around a driving pulley f. The index table itself can be rotatably indexed in a step-by-step manner, and is driven by a drive device (not shown) which cooperates with the main support shaft or spindle of the index table to effect intermittent stepped rotation thereof.

As illustrated by FIG. 6, the portion of the index table which is positioned outside the blasting section is disposed such that the pulleys i move away from and hence out of engagement with the driving belt g, whereby the support plates e outside the blasting section are maintained stationary so as to permit the fixtures A to be mounted on or removed therefrom.

The fixtures A are loaded on the nonrotating plates e which are disposed outside the blasting chamber, that is, at the loading and unloading location E. following which the table d is indexed through one increment whereby the support plate is then moved into the blasting section. After several indexing steps, the table is moved into the blasting section wherein it is disposed under the nozzle so as to subject the wafer to a stream of slurry. In the same manner, due to the indexing of the table, the table d and the fixture thereon is again moved out of the blasting section so as to be manually accessible. The wafer can then be manually inverted so as to finish the other side, or removed from the fixture.

During the blasting operation, the blasted abrasive particles which flow into the fixture and impinge against the upper surface of the wafer pass, along with the water, around the edge of the wafer into the drain passage 4, and from there the water and particles flow through the outlets 6. In this manner, the slurry does not remain within the fixture.

In the blasting machine illustrated by FIG. 3, the supply and removal of the boards containing thereon the fixtures can be expedited by positioning the boards in cassettes, whereupon the boards could then be automatically and sequentially loaded from the cassette onto the input end of the conveyor, and then sequentially moved through the blasting chamber.

It has been observed that, by utilizing the blasting step of this invention after the wafers have been sliced and rough ground, the blasting step is able to remove the metamorphosed layer formed during the slicing and grinding steps while providing parallel surfaces free of cracks, whereupon the wafer can thereafter be more efficiently lapped so as to provide the wafer with polished surfaces which are most suitable for defining the base board.

The finishing times spent during the blasting step, and following lapping step, are compared using the machine shown in FIG. 3. The silicon wafer fixtures are arranged on the board B in three lines and three rows. The wafer are blasted and then lapped. The time required to finish the wafer is as follows:

| | |
|---|---|
| Feed rate of the board (This is the line speed of the roller conveyor) | 100 mm/min. |
| Outside dia. of silicon wafer | 125 mm |
| Blasting angle between nozzle and surface | 90 degree |
| Blasting air pressure | 3 kg/cm · cm |
| Kind of abrasive particle | Silicon carbide |
| Mesh size of abrasive particles | #400 |
| Number of guns | 9 guns in three rows, three guns per row |
| Blasting time | 12 min. |
| Removed stock by blasting in thickness | 20 μm |
| Lapping time | 7.4 min. |
| Removed stock by lapping in thickness | 5.0 μm |
| Finishing time by conventional process without using blasting | 35 to 40 min. |
| Reduction rate of operation time | 1:2 or 1:1.7 |

As indicated by the above, effective results can be achieved utilizing a blasting step for finishing the surface of the wafer, prior to the final lapping step. The blasting step provides the wafer with a satin matte finish on the surfaces thereof, and is effective in removing the fine cracks and the metamorphosed layer created by the steps prior to the blasting process. Consequently, after the blasting has been completed, the subsequent lapping of the surfaces is highly effective for finishing the wafer surfaces so as to provide a mirrorlike polished surface. The lapping time itself is so significantly reduced that the total sum of the lapping time and the blasting time is less than the time needed in a conventional lapping process (that is, one not using the blasting step of this invention). Hence, the finishing time needed to finish the silicon wafer, beginning from slicing of the crystal block and ending with the mirrorlike polished surface, is significantly reduced, as illustrated by the above example.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an apparatus for wet blasting of thin disk-shaped wafers such as of silicon, said apparatus including a blasting chamber containing gun means therein for ejecting a blasting slurry against said wafer, and a removable fixture for supporting the wafer therein when it is subject to blasting with the slurry, the improvement wherein said fixture comprises:

wall means for supporting and closely circumferentially surrounding a single said wafer therein, said wall means defining an upwardly opening cup-shaped member constructed of a rubberlike resilient material, said cup-shaped member defining therein a substantially cylindrical cavity which opens upwardly and has a diameter which is only slightly larger than the diameter of the wafer, said cup-shaped member having a bottom wall portion and a tubular side wall poriton which projects upwardly therefrom in surrounding relationship to said cylindrical cavity, said cup-shaped member also having a substantially cylindrical support part which is associated with said bottom wall portion and which projects upwardly therefrom at the bottom of said cylindrical cavity, said support part defining thereon an upper surface for bearingly supporting the underside of the wafer thereon when the latter is disposed within the cavity, said upper surface being spaced downwardly a substantial distance from an upper edge of said tubular side wall portion, said cup-shaped member defining therein a substantially annular drain passage disposed within the tubular side wall portion in surrounding relationship to said support part, said annular drain passage being disposed at an elevation below said upper surface and opening upwardly into said cylindrical cavity, said cup-shaped member also having at least one outlet drain opening communicating with said annular drain passage and extending outwardly through said wall means for permitting external discharge of the slurry from the cylindrical cavity.

2. An apparatus according to claim 1, wherein the cup-shaped member has a plurality of said outlet drain openings formed therein and projecting radially outwardly through the tubular side wall portion from said annular drain passage, said plurality of outlet drain openings being spaced circumferentially around the cup-shaped member and being sloped downwardly as they project outwardly.

3. An apparatus according to claim 2, wherein said support part has a plurality of grooves extending transversely thereacross in open communication with said upper surface, said grooves having ends which open directly into said annular drain passage.

4. An apparatus according to claim 1, wherein said support part has a plurality of grooves extending transversely thereacross in open communication with said upper surface, said grooves having ends which open directly into said annular drain passage.

5. An apparatus for wet blasting of thin disk-shaped wafers, such as of silicon, said apparatus comprising:

a blasting chamber containing gun means therein for ejecting a blasting slurry;

fixture means for supporting a single said wafer therein to permit blasting of the wafer by the slurry ejected from the gun means;

a support having an upper surface thereon, and a plurality of said fixture means being individually removably supported on said upper surface;

transporting means for movably transporting the support and the plurality of fixture means disposed thereon into and out of the blasting chamber for moving the fixture means into position beneath the blasting gun means located within the blasting chamber;

said fixture means comprising an upwardly opening cup-shaped member constructed of a rubberlike material having an upwardly opening substantially cylindrical cavity, said cup-shaped member having an annular side wall which surrounds and defines said cylindrical cavity therein and which has an inner diameter which is only slightly larger than the diameter of the wafer, said cup-shaped member also having a bottom wall which effectively closes off the lower end of said annular side wall and the lower end of said cylindrical cavity, said bottom wall having a central support part which projects upwardly at a bottom poriton of said cylindrical cavity and which defines a substantially flat upper surface thereon which bearingly engages the underside of the wafer when the latter is disposed within the cavity, said upper surface being spaced downwardly form an upper edge of said annular side wall so that the latter circumferentially surrounds and confines the wafer which is supported on t he upper surface, said cup-shaped member also *defining therein a substantially annular drain* passage which is located radially between the annular side wall and the central support part, said drain passage being in continuous upward communication with the cylindrical cavity, and at least one outlet drain passage communicating with the substantially annular drain passage and opening outwardly through the wall of the cup-shaped member for permitting external discharge of slurry from the cavity.

6. An apparatus according to claim 5, wherein said cup-shaped member has a plurality of said outlet passages formed therein and projecting radially outwardly through the side wall thereof, said plurality of outlet passages being spaced circumferentially relative to said cup-shaped member, and said outlet passages being sloped downwardly as they project radially outwardly.

7. An apparatus according to claim 6, wherein said cup-shaped member is of a resilient rubberlike material having a Durometer hardness of about 60 or below.

8. An apparatus according to claim 6, wherein said substantially annular drain passage totally encircles said central support part.

* * * * *

UNITED STATES PATENT AND TRADEMARK OFFICE

CERTIFICATE OF CORRECTION

PATENT NO. : 4 738 056

DATED : April 19, 1988

INVENTOR(S) : Akira SUZUKI

It is certified that error appears in the above-identified patent and that said Letters Patent is hereby corrected as shown below:

Column 7, Line 4; change "form" to ---from---.

Signed and Sealed this

Twentieth Day of September, 1988

*Attest:*

DONALD J. QUIGG

*Attesting Officer*

*Commissioner of Patents and Trademarks*